United States Patent [19]

Kondo

[11] Patent Number: 4,662,133

[45] Date of Patent: May 5, 1987

[54] FLOOR SYSTEM FOR SEISMIC ISOLATION

[75] Inventor: Hirofumi Kondo, Yokohama, Japan

[73] Assignee: Kabushiki Kaisha Toshiba, Kawasaki, Japan

[21] Appl. No.: 752,613

[22] Filed: Jul. 8, 1985

[30] Foreign Application Priority Data

Oct. 30, 1984 [JP] Japan ..... 59-228504

[51] Int. Cl.[4] ..... E04H 9/02

[52] U.S. Cl. ..... 52/167; 248/636; 248/638; 248/567

[58] Field of Search ..... 52/167; 248/636, 638, 248/567, 562; 267/140.5

[56] References Cited

U.S. PATENT DOCUMENTS

| | | | |
|---|---|---|---|
| 1,651,411 | 12/1927 | Porter | 52/167 |
| 2,001,169 | 5/1935 | Wallace | 52/167 |
| 2,312,718 | 3/1943 | Kouyoumjian | 248/638 |
| 4,040,590 | 8/1977 | Baratoff | 248/638 |
| 4,371,143 | 2/1983 | Ishida | 52/167 |
| 4,402,483 | 9/1983 | Kurabayashi | 248/638 |
| 4,517,778 | 5/1985 | Nicolai | 52/167 |
| 4,527,365 | 7/1985 | Yoshizawa | 52/167 |
| 4,554,767 | 11/1985 | Ikonomou | 52/167 |

FOREIGN PATENT DOCUMENTS

| | | |
|---|---|---|
| 58-36144 | 6/1983 | Japan . |
| 58-36145 | 6/1983 | Japan . |
| 0124843 | 7/1983 | Japan . |

*Primary Examiner*—John E. Murtagh

*Attorney, Agent, or Firm*—Oblon, Fisher, Spivak, McClelland & Maier

[57] ABSTRACT

A floor system for seismic isolation comprises a floor member disposed above a foundation, a plurality of supports for supporting the floor member in a manner to be movable in a horizontal direction and a number of restoring devices disposed between the foundation and the floor member and each comprising first and second restoring units. The first and second restoring units have the same structure and are arranged in the directions perpendicular to each other. The restoring unit comprises a pair of sliding members movable toward and away from each other; tension coil springs anchored between the sliding members to couple one of the sliding members to the other sliding member, a plurality of stoppers for preventing these sliding members from being moved within a predetermined distance toward each other, and engaging members secured to the floor member and adapted to, when the floor member is moved relative to the foundation, engage with the sliding member to permit it to be moved against an urging force of the tension coil spring.

13 Claims, 13 Drawing Figures

FLOOR SYSTEM FOR SEISMIC ISOLATION

BACKGROUND OF THE INVENTION

This invention relates to a floor system for seismic isolation which exhibits a proper seismic isolation function against an external vibration or force, such as an earthquake.

For example, electronic computers and generators for emergency, and hazardous materials, such as dynamite and chemicals, are readily sensitive to an adverse influence by the above-mentioned. Such apparatus, equipments, or casings for holding hazardous materials must be effectively protected.

In order to protect such vibration-sensitive apparatus and hazardous materials against an external vibration, two countermeasures have conventionally been adopted as set forth in more detail below:

The first countermeasure is to properly design such apparatus per se or the equipment for holding such hazardous materials so as to enhance their rigidity and to increase their natural frequency so as to avoid a possible resonance to the frequency of the external vibration. However, the first countermeasure involves highly expensive apparatuses or equipments and is not practical.

The second countermeasure is to provide a seismic isolation function to a floor on which various vibration-sensitive apparatus are installed. A number of elastic seismic elements are located, between a floor member and a foundation elastically supporting the floor member. A system for seismic isolation including the elastic members, floor member, and apparatuses or equipments which are placed on the floor member, is set to a very small natural frequency, thereby avoiding the resonance of the system against the external vibration. Since, according to the second countermeasure, the external vibration can be absorbed by the elastic members, only a damped vibration is, in reality, transmitted to the apparatus or the equipment on the floor member. It is, therefore, not necessary to provide an adequate rigidity to the apparatuses or equipments. As a result, the cost of the apparatus equipments is not higher than in the case of the first countermeasure.

U.S. Pat. No. 4,371,143 discloses a floor system for seismic isolation as an example of the embodiment of the second countermeasure. The known floor system includes a number of apparatus which exhibit a seismic isolation function and are arranged between the floor member and the foundation. Stated in more detail, the seismic isolation apparatus comprises a plate-like base disposed on the foundation, a plate-like carrier so disposed on the base as to be slidably moved in a horizontal direction, and coupled to the lower surface of the floor member, and anti-seismic holders for elastically holding the carrier against the base. Here, the anti-seismic holder comprises an elastic element which encloses the outer peripheral portion of the carrier and adapted to tighten the carrier, from outside, with a predetermined force, and stopper elements secured to the base to permit them to be regulated against movement in a direction in which the elastic element is contracted.

In consequence, in the normal state, the carrier is held on the base in a predetermined position. Stated in more detail, the elastic element comprises four tension coil springs arranged along the respective sides of the carrier and four connector members connecting the respective tension coil springs together.

According to the floor system for seismic isolation, if a vibration force exceeding a tension force initially given to the tension coil springs is transmitted to the seismic isolation apparatus due to, for example, the occurrence of an earthquake, the carrier and, thus the floor member, is moved in the horizontal direction against an urging force of the tension coil springs. That is, the vibration energy of the earthquake is stored in the tension coil springs, thereby damping a vibration force actually transmitted to the apparatus on the floor member.

According to the above-mentioned floor system, however, if a breakage occurs at one location of the elastic element surrounding the carrier at one tension coil spring, the elastic element completely fails to perform its own function. It is therefore impossible to exhibit the above-mentioned seismic isolation function.

There is also a disadvantage that if a rotational force acts, in a horizontal direction, upon the floor member by a vibration resulting from an earthquake, it is not possible to effectively decrease the rotational movement of the floor member. Now suppose that a number of seismic isolation apparatus are arranged, in a matrix array, between the foundation and the floor member. In this case, only those seismic isolation apparatus located in closest proximity to the outer periphery of the floor member effectively serve to suppress the rotational movement of the floor member. Stated in more detail, a force acting upon the respective seismic isolation apparatus when the floor member tends to rotate around a center point corresponds to a turning effort represented by a product of the rotational force and a distance from the center point to the seismic isolation apparatus. Thus, tension springs of the seismic isolation apparatus arranged in closest proximity to the outer periphery of the floor member most effectively serve to suppress the rotational movement of the floor member. Moreover, among the four tension coil springs of the seismic isolation apparatus, only one tension coil spring closest to the outer periphery of the floor member most effectively functions to suppress the rotational movement of the floor member. Even if a number of seismic isolation apparatuses are provided below the floor member, it is not possible to effectively suppress the rotational movement of the floor member and thus to obtain a greater seismic isolation effect.

Since the four tension coil springs are so linked as to surround the carrier, the known seismic isolation apparatus becomes bulkier and complex due to the presence of the four tension coil springs.

SUMMARY OF THE INVENTION

It is accordingly an object of this invention to provide a floor system for seismic isolation which can effectively perform a seismic isolation operation with high reliability and can be compact.

The above-mentioned object of this invention is achieved by the floor system for seismic isolation as set forth in more detail below. The floor system of this invention includes a floor member disposed above a foundation with a spacing therebetween and on which is placed an object to be damped for seismic isolation. Supports are disposed between the foundation and the floor member to support the floor member such that it is movable in a horizontal direction. A plurality of restoring devices are disposed between the foundation and the floor member such that, when the floor member is moved in the horizontal direction from its initial position relative to the foundation, the restoring devices become effective to cause the floor member to be returned to the initial position. The respective restoring device comprises first and second restoring units. The first restoring unit comprises a pair of first moving members disposed on one of the upper surface of the foundation and lower surface of the floor member and movable, in a horizontal direction, toward and away from each other, first stopping means for preventing the pair of first moving members from being moved within a predetermined distance toward each other, first tension spring means for connecting the pair of first moving members to each other, and first engaging members provided on the other of the upper surface of the foundation and lower surface of the floor member and adapted to, when the floor member is moved in the horizontal direction relative to the foundation, engage with one of the first moving members to permit the first moving member to be moved away from the other first moving member against an urging force of the first tension spring means.

On the other hand, the second restoring unit comprises a pair of second moving members provided on one of the upper surface of the foundation and lower surface of the floor member and movable toward and away from each other in a second horizontal direction perpendicular to the first horizontal direction, second stopper means for preventing the pair of second moving members from being moved within a predetermined distance toward each other, second tension spring means for connecting the pair of second moving members to each other, and second engaging members provided on the other of the upper surface of the foundation and lower surface of the floor member and adapted to, when the floor member is moved in the second horizontal direction, engage with one of the second moving members to permit the second moving member to be moved away from the other second moving member against an urging force of the second tension spring means.

The first and second restoring units are similar to each other except that the pair of first moving members are movable in the first horizontal direction and that the pair of second moving members are moved in the second horizontal direction perpendicular to the first horizontal direction.

In the floor system of this invention, when the floor member is reciprocally moved in the horizontal direction in the first horizontal direction due to the vibration of an earthquake, the pair of first moving members in the first restoring unit are alternately moved against the urging force of the first tension spring means. As a result, some of the vibration tending to be transmitted to the floor member is converted to the internal energy of the first tension spring means and stored in the first tension spring means, causing the external force (vibration energy) tending to be transmitted to the floor member to be damped down to a low level. After the earthquake ceases, the floor member is automatically returned to the initial position under a recovery force of the first tension spring means. Even when the floor member is moved in the second horizontal direction perpendicular to the first horizontal direction, it is still possible to damp such external force, tending to be transmitted to the floor member, down to a low level, and after the earthquake ceases, the floor member can be automatically returned to the initial position under the recovery force of the second restoring unit.

As evident from the above explanation, since the respective restoring device of the floor system of this invention comprises the first and second restoring units, even if the tension spring means is damaged in one of the restoring units, the other restoring unit still performs its own full seismic isolation function and thus the whole restoring device never fails to perform a seismic isolation function. In other words, the floor system of this invention can perform an excellent seismic isolation function with high reliability.

Furthermore, since the first and second restoring units are separated in the restoring device, it is possible to independently install the first and second restoring units. As the first and second restoring units in the respective restoring device can both be arranged on the peripheral portion of the floor member and, if a rotational force is transmitted to the floor member from outside, it can effectively be suppressed by the first and second restoring units.

In the floor system of this invention, the respective component parts can be made in compact form, because the storing device is separated from the support means and because the storing device is divided into the first and second restoring units. In consequence, the whole floor system of this invention can be small in height and thus it is possible to reduce the height from the foundation to the floor member.

DETAILED DESCRIPTION OF THE PREFERRED EMBODIMENTS

Figure 1:
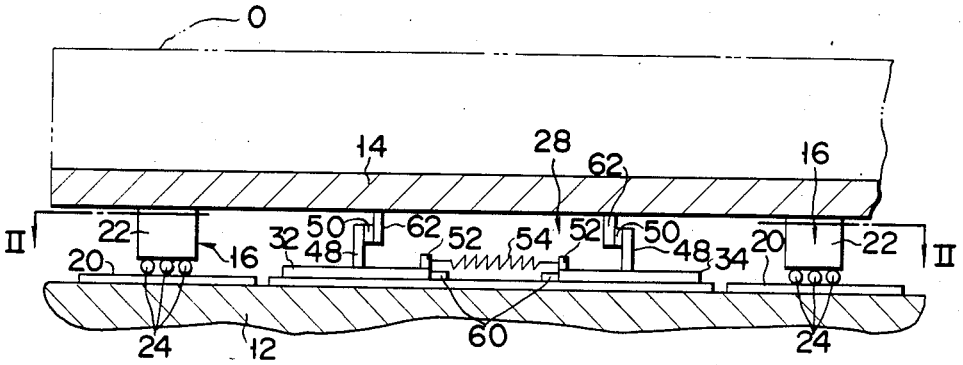
FIG. 1 is a side view diagrammatically showing a floor system according to a first embodiment of this invention.
Figure 2:
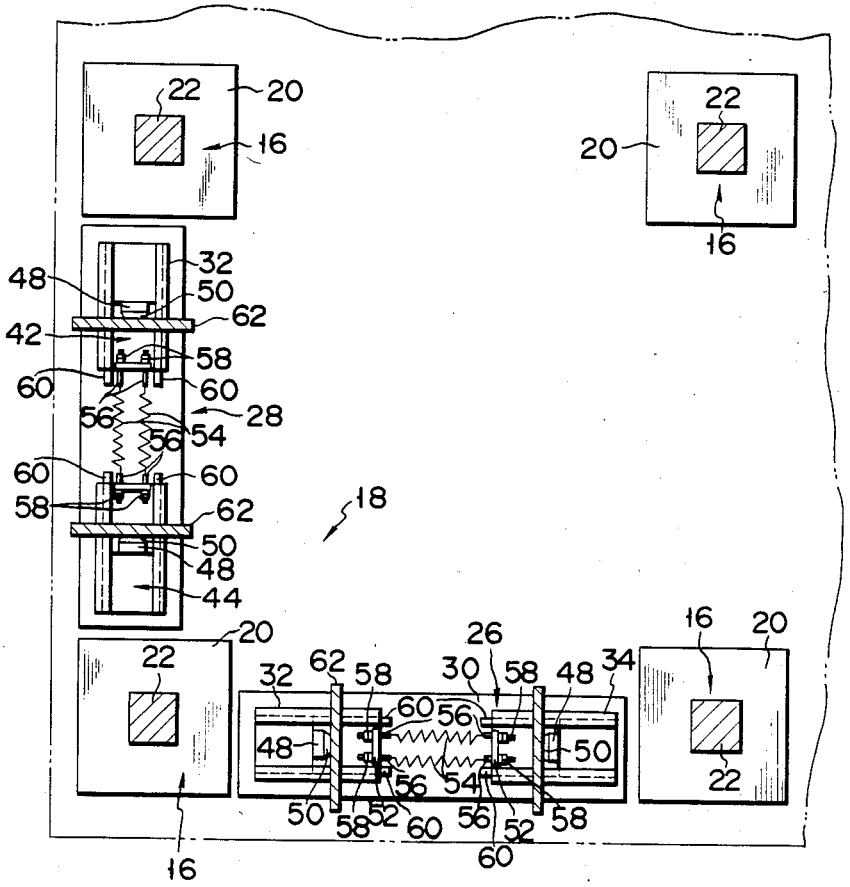
FIG. 2 is a cross-sectional view as taken along line II—II in FIG. 1.

FIGS. 1 and 2 show a floor system for seismic isolation according to a first embodiment of this invention. The floor system, if broadly divided, comprises a floor member 14 for supporting an object O for seismic isolation which is disposed above a foundation 12 of a house or a building, a plurality of supports 16 disposed between the floor member 14 and the foundation 12 and supporting the floor member 14 such that it is movable in a horizontal direction, and a plurality of restoring devices 18 disposed between the foundation 12 and the floor member 14. In FIG. 2 is shown only one restoring device 18 which is arranged at one corner of the floor member 14.

The respective supports 16 are arranged in a matrix array as shown in FIG. 2. The respective support 16 comprises a flat plate 20 fixed to the upper surface of the foundation 12, a column member 22 mounted to the lower surface of the floor member 14, and a plurality of balls or rollers attached to the lower end of the column member such that they roll on the flat plate 20.

Figure 3:
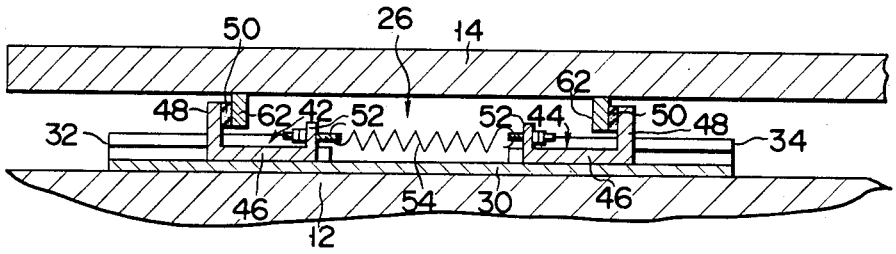
FIG. 3 is a cross-sectional view showing a restoring device.
Figure 4:
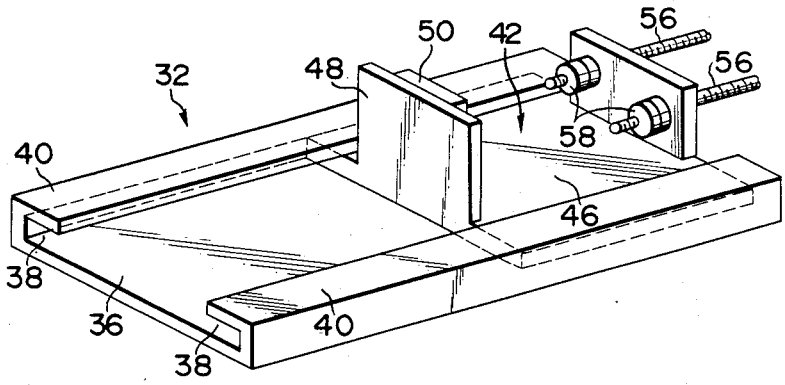
FIG. 4 is a partial, perspective view showing the restoring device.

The restoring device 18 comprises first and second restoring units 26 and 28 of the same construction. Here one of the first and second restoring units will be explained for convenience's sake. The first restoring unit 26 is disposed in the outer peripheral portion of the floor member 14 such that it is located between the two supports 16. The first restoring unit 26 includes an elongated base plate 30, as shown in FIGS. 3 and 4, which is fixed to the upper surface of the foundation 12. A pair of guide members 32, 34 are coaxially fixed one at each end portion of the upper surface of the base plate 30. The respective guide members 32 and 34, each, comprise a plate section 36 fixed to the base plate 30 and two bent sections 40 defining a pair of mutually confronting guide grooves 38, 38 along the longitudinal axis of the plate section 36. Respective sliding members 42, 44 are mounted on the guide members 32, 34 so as to be slidably moved along the longitudinal axis of the guide members. The sliding members 42, 44, each, are comprised of a plate section 46 of such a size as to permit its sides to be slidably fitted into the groove 38, a first projecting wall 48 formed on that end of the plate section which is located remote from the middle of the base plate 30 and extends toward the floor member 14, a buffer member 50 provided on the inside surface of the first projecting wall 48, and a second projecting wall 52 provided on the other end of the plate member 46 which is located near the middle of the base plate, noting that the second projecting wall 52 is lower than the first projecting wall 48. The sliding members 42, 44 are connected to each other through a pair of tension coil springs 54 which extend in a parallel direction. To explain the tension coil springs 54 in more detail, both the ends of the tension coil springs 54, 54 are anchored to screws 56, extending through the second projecting walls 52, respectively. The screws are fixed by corresponding nuts 58 to the second projecting walls 52 of the sliding members 42, 44. In consequence, the length, and thus the urging force, of the tension coil springs 54 can be adjusted by turning nuts on the screws 56. For example, four stoppers 60 are fixed to the upper surface of the base plate 30 to prevent the sliding members 42 and 44 from being moved within a predetermined distance toward to each other.

A pair of engaging members 62, 62 are attached to the lower surface of the floor member 14, as shown in FIG. 3, and extend downward such that the first projecting wall 48 carrying the buffer member 50 can abut against the engaging member 62. In this connection it is to be noted that the width of the engaging member 62 is so set as to assure the abutting of the first projecting wall 48 with the engaging member 62 even if the floor member is moved in a direction perpendicular to the longitudinal axis of the restoring device.

The second restoring unit 28 is the same in structure as the first restoring unit. Therefore, the same reference numerals are employed to designate parts or elements corresponding to those shown in the first restoring unit and further explanation is omitted for brevity's sake.

The second restoring unit 28 is, like the first restoring unit 26, disposed at the peripheral portion of the floor member 14 with its longitudinal axis located perpendicular to that of the first restoring unit 26.

The operation of floor system for the seismic isolation according to the first embodiment of this invention will be explained below in connection with the first restoring unit 26 of the restoring device 18, while referring to FIGS. 5 to 7.

Figure 5:
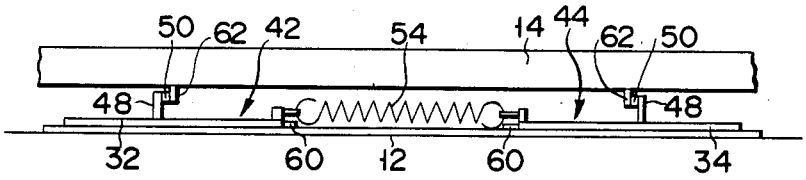
FIGS. 5 through 7 are views for explaining the function of respective restoring devices.

When there is no external vibration, such as an earthquake, to be transmitted to the foundation 12, the first projecting walls 48 carrying the buffer member 50 abut against the respective engaging members 62 and the sliding members 42, 44 abut against the respective stops 60, 60 under a recovery force of the tension coil springs 54 as shown in FIG. 5. That is, the floor member 14 is held in an initial position as shown in FIG. 5.

Figure 6:
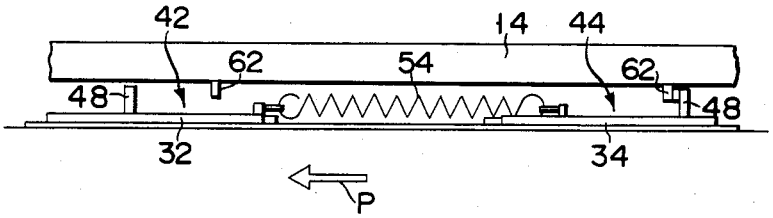
Figure 7:
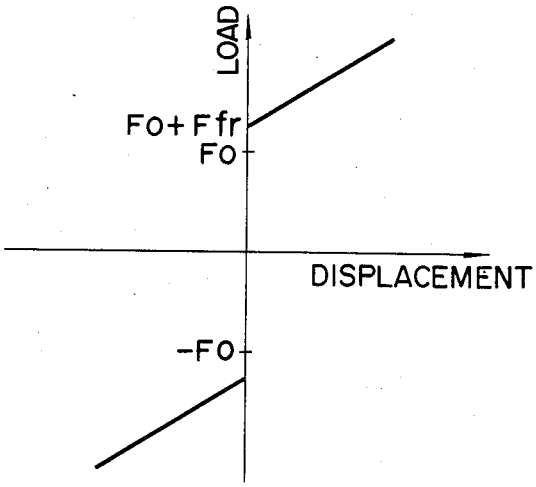

If, in this state, a vibration acts upon the foundation 12 in a direction of an arrow P in FIG. 6 to cause the foundation 12 to be displaced in the direction of the arrow P in FIG. 6, the sliding member 44 located in a direction opposite to the direction of the arrow P is slidably moved by the floor member 14 in said opposite direction. That is, as the floor member 14 tends to stay in the initial position in spite of the displacement of the foundation 12, the first projecting wall 48 of the sliding member 44 is pushed by the engaging member 62 of the floor member 14 through its buffer member 50, causing the sliding member 44 to be moved in said opposite direction against the urging force of the tension coil springs 54. As a result, a part of the vibration force, which tends to be transmitted to the floor member 14, is stored as an expanding force of the tension coil springs 54. That is, the vibration actually transmitted to the floor member 14 is suppressed down to a lower level, permitting the first restoring unit 26 to perform a better seismic isolation function. After the earthquake ceases and thus no vibration is transmitted to the floor member 14, the floor member 14 together with the sliding members 44 is automatically returned to the initial position under a recovery force of the tension coil springs 54.

When, on the other hand, the foundation 12 suffers from vibrations in a direction perpendicular to the direction of the arrow P, the second restoring unit 28 located in a direction perpendicular to that of the first restoring unit 26, like the first restoring unit 26, permits the floor member 14 to perform seismic isolation and automatic return functions. Since the restoring device 18 has the first and second restoring units 26 and 28 where their recovery forces act in a mutually perpendicular relation, it permits the floor member 14 to effectively perform the seismic isolation and automatic return functions in either horizontal direction.

Since the restoring device 18 comprises the first and second restoring units 26 and 28, it is possible to effectively suppress a rotational force even if it acts upon the floor member 14 in the horizontal direction. In other words, as the first and second restoring units 26 and 28 are both located at the peripheral portion of the floor member 14, the tension coil springs 54 of the first and second restoring units 26 and 28 can be effectively utilized to suppress the rotation force acting upon the floor member 14.

Furthermore, the restoring device 18 and the support 16 for movably supporting the floor member 14 are separately provided and, in addition, the restoring device 18 per se is also divided into the first and second restoring units, assuring a compact arrangement of the component parts of the floor system. In consequence, only a smaller space is required between the foundation 12 and the floor member 14 and thus no larger house or building is required.

Upon the restoring device 18, no greater adverse effect is exerted even if one of the springs 54 of the storing unit 26 is broken during usage. The same thing can also be true, though restricted to some extent, of the case where two tension coil springs 54 are broken, because the other restoring unit 28 permits the floor member 14 to perform the seismic isolation function to some extent. In consequence, the floor system of this invention assures a reliable seismic isolation function against the apparatuses or equipments installed on the floor member 14.

As the tension loads of the tension coil springs of the first and second restoring units 26 and 28 can be readily adjusted, it is possible to readily set a minimum acceleration applied to the floor member 14 when the floor member 14 starts to move under the vibration. This point will be further amplified by referring to FIG. 7 where the abscissa denotes a displacement of the floor member 14 and the ordinate denotes the load applied to the floor member. Now consideration is restricted only to the first restoring unit 26. In this case, if A represents an input acceleration to be applied to the movable member in the side of the floor member 14 (the movable member includes the floor member 14) will not be moved unless the following requirement is satisfied:

$$A0 > (F0 + Ffr)/m$$

where

F0: a preload of the tension coil springs 54 which is set by initially giving tension to the tension coil springs 54 of the first restoring unit;

Ffr: a static frictional force of the movable member on the side of the floor member; and m: a total mass of the movable member.

With K and δ representing a total spring constant of the tension coil springs 54 of the first restoring unit and the elongation of the tension coil springs 54, the following requirement $$mA - K\delta + Ffr$$

must be met in order to make the movable member (floor member 14) rest against the foundation 12 even if an input acceleration A1 which is greater than the input acceleration A0) is given to the movable member. Thus, from this equation the elongation δ of the tension coil springs 54 is given below:

$$\delta = (mA - Ffr)/K$$

That is, if the tension coil springs 54 is tensioned by an amount δ, it can readily set the input acceleration A1 at which the movable member (floor member 14) starts to be moved.

Figure 8:
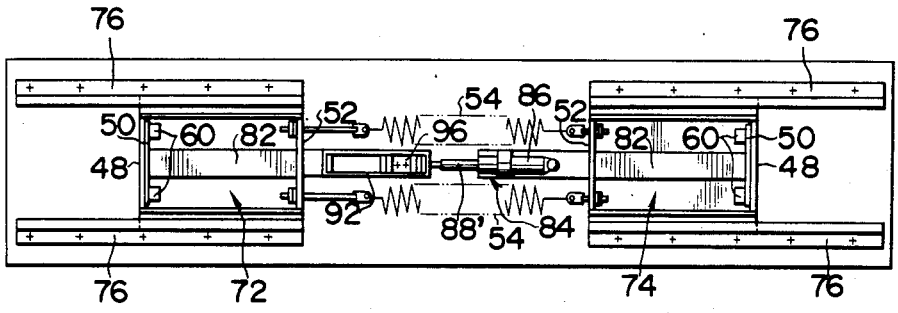
FIG. 8 is a plan view showing a restoring device of a second embodiment of this invention.
Figure 9:
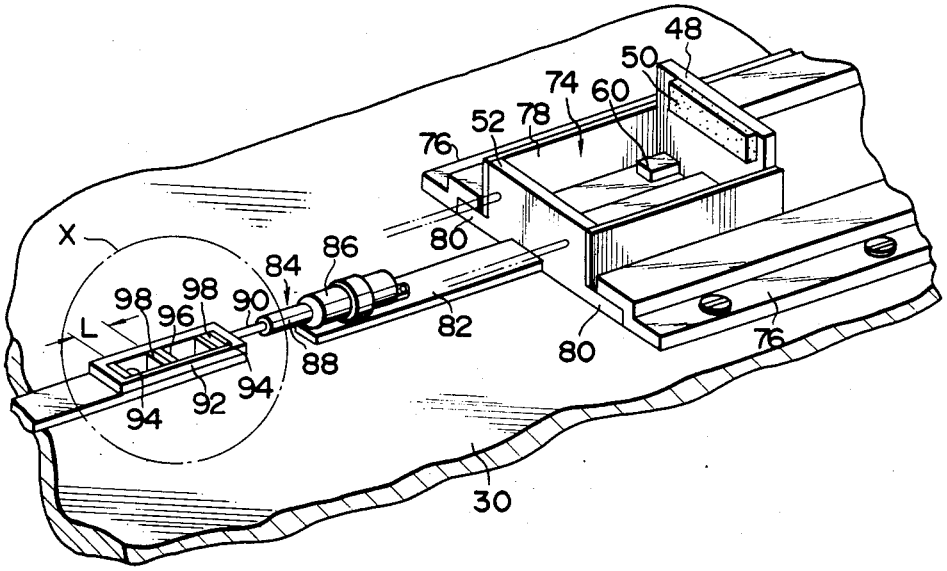
FIG. 9 is a partial, perspective view showing the storing device of FIG. 8.
Figure 10:
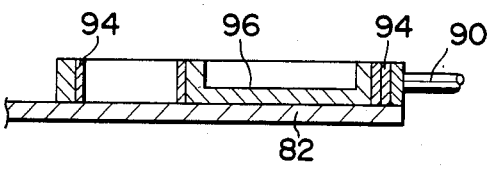
FIG. 10 is a cross-sectional view showing a section as indicated by X in FIG. 9.

This invention is not restricted to the seismic isolation floor system according to the first embodiment of this invention. FIGS. 8 to 10 show first and second restoring units 26 and 28 in a restoring device 18 of a floor system for seismic isolation according to a second embodiment of this invention. The same reference numerals are employed to designate parts or elements corresponding to those shown in FIGS. 3 to 4. Therefore, further explanation is omitted except in the following respects.

First and second restoring units 26 and 28 of the second embodiment include a pair of sliding members 72, 74 of a bottomless box-like configuration. The sliding members 72 and 74 comprise a box section 78 of such a size as to be fitted between a pair of guide members 76, 76 and a pair of blade members 80, 80 horizontally extending toward the guide members 76, 76 and sandwiched between a base plate 30 and the corresponding guide member 76. The box section 78 is comprised of first and second projecting walls 48 and 52 and a pair of side plates which connect the first projecting wall 48 to the second projecting wall 52. In the second embodiment, a respective support plate 82 is provided one end of which extends through the second projecting wall 52 and is secured to the lower portion of the first projecting wall 48 of the box section 78 and the other end of which extends toward the other sliding member. In the second embodiment of this invention, stoppers for the sliding members 72 and 74 are each secured to the upper surface of the base plate 30 such that each abuts against the lower portion of the first projecting wall 48 of the sliding members 72 and 74.

The support plates 82 provided at the sliding members 72, 74 are connected together through a hydraulic damper 84. To the forward end of the support plate 82 on the side of the sliding member 72 an external cylinder 86 of the hydraulic damper 84 is fixed with its axis extending parallel to the tension coil springs 54. A rod 90 coaxially extends through an inner cylinder 88 of the hydraulic damper 84 and a rectangular frame member 92 is fixed to the forward end of the rod 90. A pair of buffer member 94 are mounted on the inner surface of the frame member 92. On the other hand, projections 96 are fixed to the end portion of the support plate 82 on the side of the sliding member 72. The projection 96 is so fitted into the frame member 92 with a space L left that it can slide in the direction in which the sliding members 72 and 74 are moved. A buffer member 98 is fixed to the projection 96 such that it faces the buffer member 94 of the frame member 92.

It is evident that, even in the first and second restoring units 26 and 28 of the second embodiment, the same results can also be obtained as in the first embodiment. When one 74 of the sliding members is moved away from the other sliding member 72 by a distance exceeding the distance (space) L, the hydraulic damper 84 is extended so that it can perform a damping function. That is, when the amplitude with which the floor member 14 is moved relative to the foundation 12 exceeds the distance L, the hydraulic damper 84 performs the damping function, suppressing the displacement of the floor member 14 down to a small amount and assuring an ideal seismic isolation function.

Figure 11:
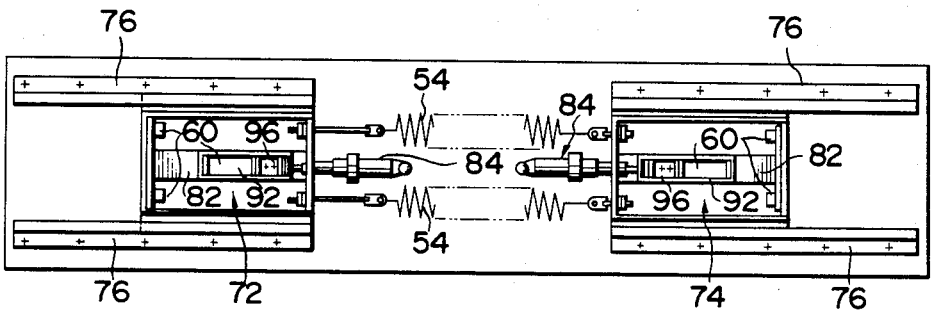
FIG. 11 is a plan view showing a restoring device of a third embodiment of this invention.

FIG. 11 shows a restoring unit of a third embodiment of this invention which includes hydraulic dampers 84 between respective sliding members 72, 74 and a base plate 30. That is, the respective hydraulic damper 84 has its outer cylinder 86 fixed to a base plate 30 and its inner cylinder coupled to a frame member 92 through a rod 90. A projection 96, which is projected on the upper surface of a support plate 82, is fitted in the frame member 92 such that it is slidable relative to the frame member, noting that the support plate 82 is mounted only on the lower side of the sliding member. Needless to say, the restoring unit is so constructed that the respective hydraulic damper 84 performs the same function as in the second embodiment.

Figure 12:
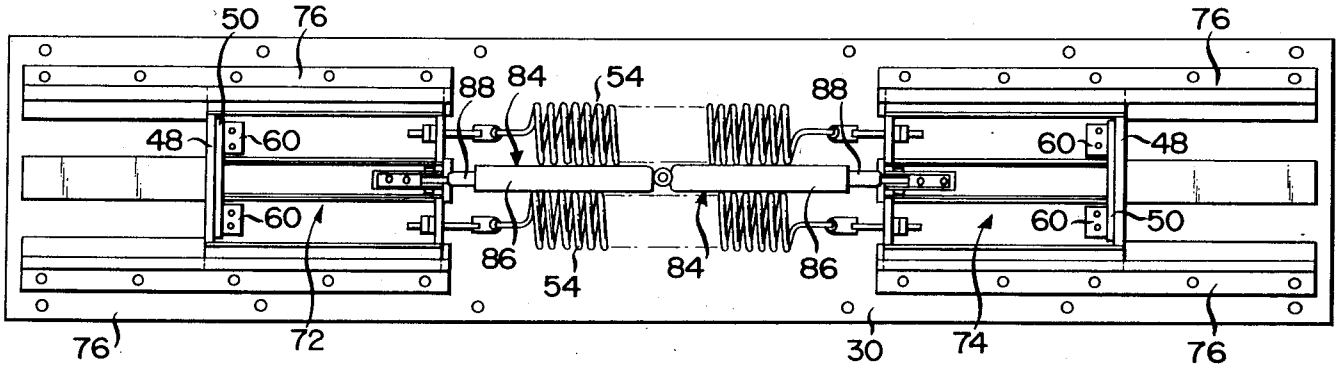
FIG. 12 is a plan view showing a restoring device of a fourth embodiment.
Figure 13:
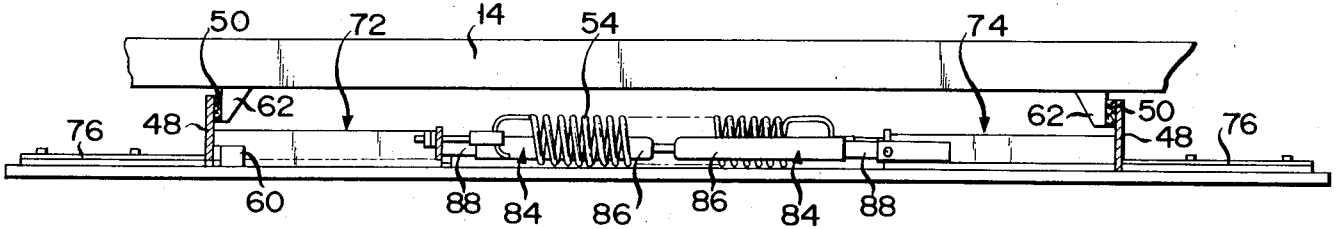
FIG. 13 is a cross-sectional view showing the restoring device of FIG. 13.

FIGS. 12 and 13 show a restoring unit of a fourth embodiment of this invention which includes hydraulic dampers 84 arranged between the sliding members 72 and 74. That is, each hydraulic damper 84 has its outer cylinder 86 connected to each other. While, the inner cylinder 88 of hydraulic dampers 84 are coupled to the sliding members 72 and 74, respectively. In the embodiment of FIGS. 12 and 13, the hydraulic cylinders 84 are arranged between the sliding members 72 and 74, a single hydraulic cylinder may be used.

Although, in the respective embodiments, two tension coil springs are incorporated in the respective restoring units, a single tension coil spring or more than two coil springs may be used. Furthermore, any other types of dampers may be used in place of the hydraulic damper.

In the above-mentioned embodiments, the restoring device 18 is disposed on the foundation 12 with the engaging member 62 fixed to the lower surface of the floor member, but may be disposed on the lower surface of the floor member with the engaging member 62 fixed to the foundation 12.

What is claimed is:

1. A floor system for seismic isolation, comprising:

a floor member disposed above a foundation with a space left therebetween and on which is disposed an object to be damped for seismic isolation;

support means for supporting the floor member such that the floor member is movable in a horizontal direction; and a plurality of restoring devices located between the foundation and the floor member and adapted to, when the floor member is moved in the horizontal direction from an initial position relative to the foundation, produce a restoring force to return the floor member to the initial position;

the restoring device including first and second restoring units;

the first restoring unit including:

(a) a pair of first moving members disposed on one of the upper surface of the foundation and lower surface of the floor member to be moved toward and away from each other in a first horizontal direction;

(b) first stopper means for preventing the pair of first moving members from being moved within a predetermined distance toward each other;

(c) first tension spring means (54) for connecting the pair of first moving members to each other; and (d) first engaging members provided on the other of the upper surface of the foundation and lower surface of the floor member and adapted to, when the floor member is moved in the first horizontal direction relative to the foundation, engage with one of the first moving members to cause said one of the first moving members to be moved away from the other of the first moving members against an urging force of the first tension spring means;

the second restoring unit including:

(a) a pair of second moving members disposed on one of the upper surface of the foundation and lower surface of the floor member to be moved toward or away from each other in a second horizontal direction perpendicular to the first horizontal direction;

(b) second stopper means for preventing the second moving members from being moved within a predetermined distance toward each other;

(c) second tension spring means for connecting the pair of second moving members to each other; and (d) second engaging members provided on the other of the upper surface of the foundation and lower surface of the floor member and adapted to, when the floor member is moved relative to the foundation in the second horizontal direction, engage with the second moving member to permit it to be moved away from the other second moving member against an urging force of the second tension spring means.

2. A floor system for seismic isolation, according to claim 1, in which the support means comprises a plurality of supports, each of which is comprised of a plate member fixed to the foundation, a column member provided on the lower surface of the floor member to extend toward the plate member, and at least one ball mounted on the lower end of the column member such that it can be rolled on the plate member.

3. A floor system for seismic isolation, according to claim 1, in which the first and second tension spring means of the first and second restoring units, each, include at least one tension coil spring.

4. A floor system for seismic isolation, according to claim 3, in which the first and second tension spring means of the first and second restoring units include adjusting means for adjusting the length of the tension coil spring.

5. A floor system for seismic isolation, according to claim 4, in which the adjusting means includes a screw connected to at least one end of the tension coil spring and held to be movable relative to the moving member in an axis direction and a nut for fixing the screw to the moving member.

6. A floor system for seismic isolation, according to claim 1, in which the first and second restoring units are mounted on the foundation.

7. A floor system for seismic isolation, according to claim 6, in which the first and second restoring units further comprise guide members fixed to the foundation for slidably guiding the first and second moving members in said first and second horizontal directions.

8. A floor system for seismic isolation, according to claim 6, in which the first and second moving members of the first and second restoring units include a wall projecting toward the lower surface of the floor member, and the engaging members of the first and second restoring units include engaging plate secured to the lower surface of the floor member to permit it to abut against the projecting wall.

9. A floor system for seismic isolation, according to claim 8, in which a buffer member is mounted between the corresponding abutting surfaces of the projecting wall and said engaging plate.

10. A floor system for seismic isolation, according to claim 1, further comprising damper means located between the upper surface of the foundation and the floor member.

11. A floor system for seismic isolation, according to claim 1, in which the first and second restoring units further comprise damper means located between the pair of moving members.

12. A floor system for seismic isolation, according to claim 1, in which the first and second restoring units further include damper means for restricting a movement of the moving members when their moving members are moved away from each other beyond a predetermined distance.

13. A floor system for seismic isolation, according to claim 12, in which the damper means includes a hydraulic damper having an outer cylinder fixed to one of the pair of moving members, a frame member coupled to an inner cylinder of the hydraulic damper, and a member provided in the other moving member and fitted into the frame member such that it is movable in a direction of movement of the movable member.

* * * * *